US007239078B2

(12) United States Patent
No

(10) Patent No.: US 7,239,078 B2
(45) Date of Patent: Jul. 3, 2007

(54) FIELD EMISSION DISPLAY AND DRIVING METHOD THEREOF

(75) Inventor: Hyang-Suk No, Kochang-gun (KR)

(73) Assignee: Samsung SDI Co., Ltd., Suwon-si (KR)

( * ) Notice: Subject to any disclaimer, the term of this patent is extended or adjusted under 35 U.S.C. 154(b) by 155 days.

(21) Appl. No.: 10/916,661

(22) Filed: Aug. 11, 2004

(65) Prior Publication Data

US 2005/0073830 A1 Apr. 7, 2005

(30) Foreign Application Priority Data

Oct. 2, 2003 (KR) ..... 10-2003-0068805

(51) Int. Cl.
*G09G 3/22* (2006.01)

(52) U.S. Cl. ..... 313/497; 315/169.3; 345/75.2; 362/84

(58) Field of Classification Search ..... 362/84; 313/495, 496, 497, 364; 315/169.1, 169.3; 345/74.1, 75.2, 204, 690
See application file for complete search history.

(56) References Cited

U.S. PATENT DOCUMENTS 6,369,784 B1 * 4/2002 Maslennikov et al. ..... 345/75.2
2003/0006947 A1 * 1/2003 Moon ..... 345/75.2

* cited by examiner

*Primary Examiner*—Sandra O'Shea
*Assistant Examiner*—Bao Q. Truong
(74) *Attorney, Agent, or Firm*—Christie, Parker and Hale, LLP

(57) ABSTRACT

A field emission display (FED) and a driving method thereof. The FED of the present invention sequentially applies a selection signal to second electrodes through a scan driver, a data signal to a first group of first electrodes through a first data driver, and a data signal to a second group of the first electrodes through a second data driver. In this way, data lines are divided into data lines in the upper side of the screen and data lines in the lower side of the screen and are then separately driven, thereby preventing a non-uniform brightness of the upper and lower sides of the screen caused by a resistance component of the data lines.

7 Claims, 4 Drawing Sheets

FIELD EMISSION DISPLAY AND DRIVING METHOD THEREOF

CROSS REFERENCE TO RELATED APPLICATION

This application claims priority to and the benefit of Korea Patent Application No. 2003-68805 filed on Oct. 2, 2003 in the Korean Intellectual Property Office, the content of which is incorporated herein by reference.

BACKGROUND OF THE INVENTION (a) Field of the Invention

The present invention relates to a field emission display (FED) and a driving method thereof.

(b) Description of the Related Art

The flat panel display (FPD), which is an image pick-up device using cold cathode electrons as an electron emission source, has its quality greatly dependent upon characteristics such as the material of an electron emission region, or the structure.

FIG. 1 is a perspective view of a general FED. FIG. 2 is a cross-sectional view of the general FED shown in FIG. 1.

Referring to FIGS. 1 and 2, the general FED includes emitter 30 formed on rear substrate 1 as a source of electrons 60; cathode electrode 10 and gate electrode 20 for emitting electrons from emitter 30; and phosphorous surface 50 formed with red (R), green (G), and blue (B) phosphors and anode electrode 40 on the one side of front substrate 2 opposing rear substrate 1. The FED of this structure forms an electric field around the emitter using the voltage difference between the cathode and gate electrodes to emit electrons from the emitter and makes the emitted electrons collide with the phosphorous surface for light emission to realize a defined image.

Here, the cathode and gate electrodes are used as scan and data electrodes, respectively. Alternatively, the cathode and gate electrodes may be used as data and scan electrodes, respectively.

The FED is driven by the passive matrix method that involves light emission of pixels by a potential difference (between gate and cathode electrodes) caused by the driving pulses applied to a scan driver for driving horizontal scan electrodes and a data driver for driving vertical data electrodes. Furthermore, the gray scale is represented according to the overlapping width of the two driving pulses.

The FED applies a data signal only in one direction of the screen in applying data pulses to data lines, which include a resistance component to increase a voltage drop in the lower side of the screen. This voltage drop affects the brightness of the image because the FED uses the potential difference between gate and cathode electrodes for light emission. Accordingly, the left bottom of the screen having a high voltage drop relative to the right top appears dark, so that uniform brightness of the panel is not provided and the screen can appear rough and blotched.

SUMMARY OF THE INVENTION

In accordance with the present invention an FED and a driving method thereof is provided for enhancing uniform brightness of an image to be displayed.

In one aspect of the present invention, there is provided a field emission display which includes: a first substrate; a plurality of first electrodes formed on the first substrate in one direction; a plurality of second electrodes insulated from and alternating with the first electrodes; an electron emission region for emitting electrons by a potential difference between the first and second electrodes; and a driver for outputting a signal corresponding to each of the first and second electrodes. The first electrodes are divided into plural adjacent groups, with one group including at least one of the first electrodes. The driver includes first and second data drivers for outputting a data signal corresponding to the first electrodes, and a scan driver for outputting a selection signal to the second electrodes. The first data drivers output a data signal to a plurality of the first electrodes belonging to the one of the two adjacent groups, and the second data drivers output a data signal to a plurality of the first electrodes belonging to the other one of the two adjacent groups.

The respective first electrodes sequentially correspond to any one of R, G, and B phosphors.

Each group includes one of the first electrodes, or three of the first electrodes corresponding to the R, G, and B phosphors, respectively.

Preferably, the first electrodes include a gate electrode, and the second electrodes include a cathode electrode.

The first and second data drivers are separately disposed in the upper and lower sides of a screen for displaying an image.

In another aspect of the present invention, there is provided a method for driving a field emission display that includes a first substrate, a plurality of first electrodes formed on the first substrate in one direction, a plurality of second electrodes insulated from and alternating with the first electrodes, an electron emission region for emitting electrons by a potential difference between the first and second electrodes, and a driver for outputting a signal corresponding to each of the first and second electrodes. The first electrodes are divided into plural groups, with one group including at least one of the first electrodes. The driver includes first and second data drivers for outputting a data signal corresponding to the first electrodes, and a scan driver for outputting a selection signal to the second electrodes. The method includes: (a) sequentially applying the selection signal to the second electrodes through the scan driver; and (b) applying the data signal to a first group of the first electrodes through the first data driver, and applying the data signal to a second group of the first electrodes through the second data driver.

DETAILED DESCRIPTION

Figure 1:
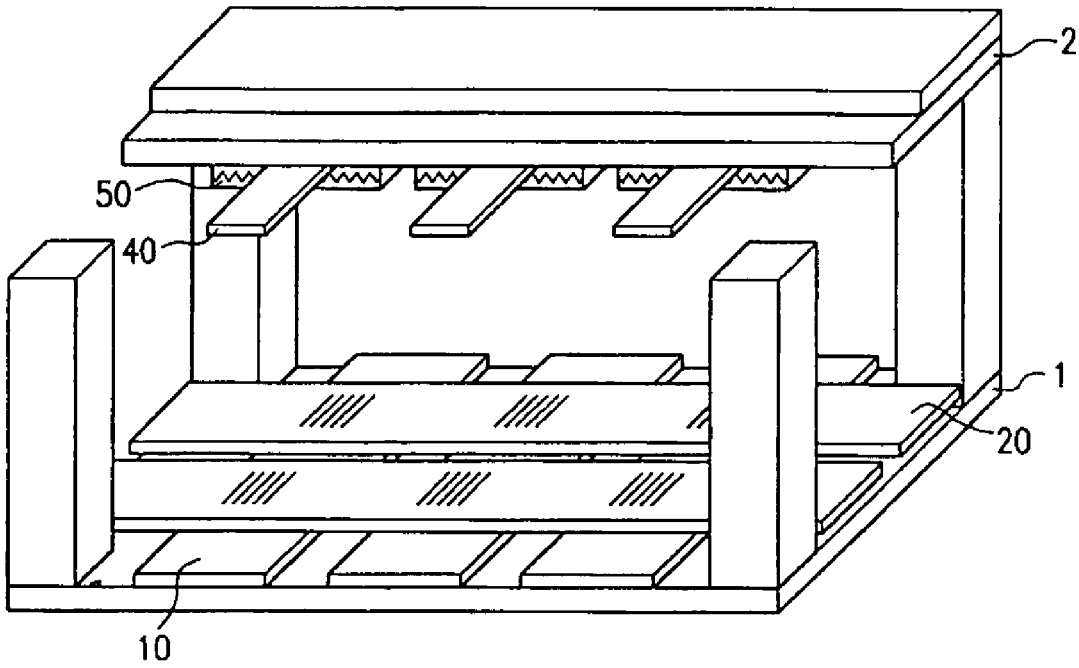
FIG. 1 is a perspective view of a general FED.
Figure 2:
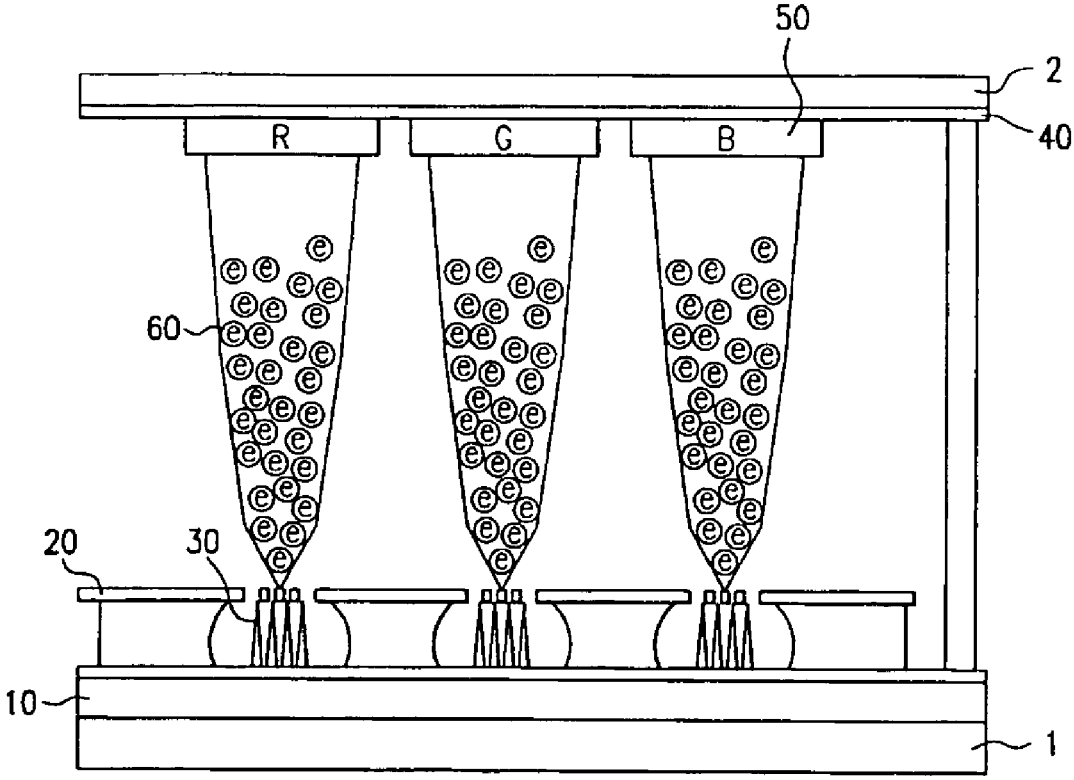
FIG. 2 is a cross-sectional view of the general FED shown in FIG. 1.
Figure 3:
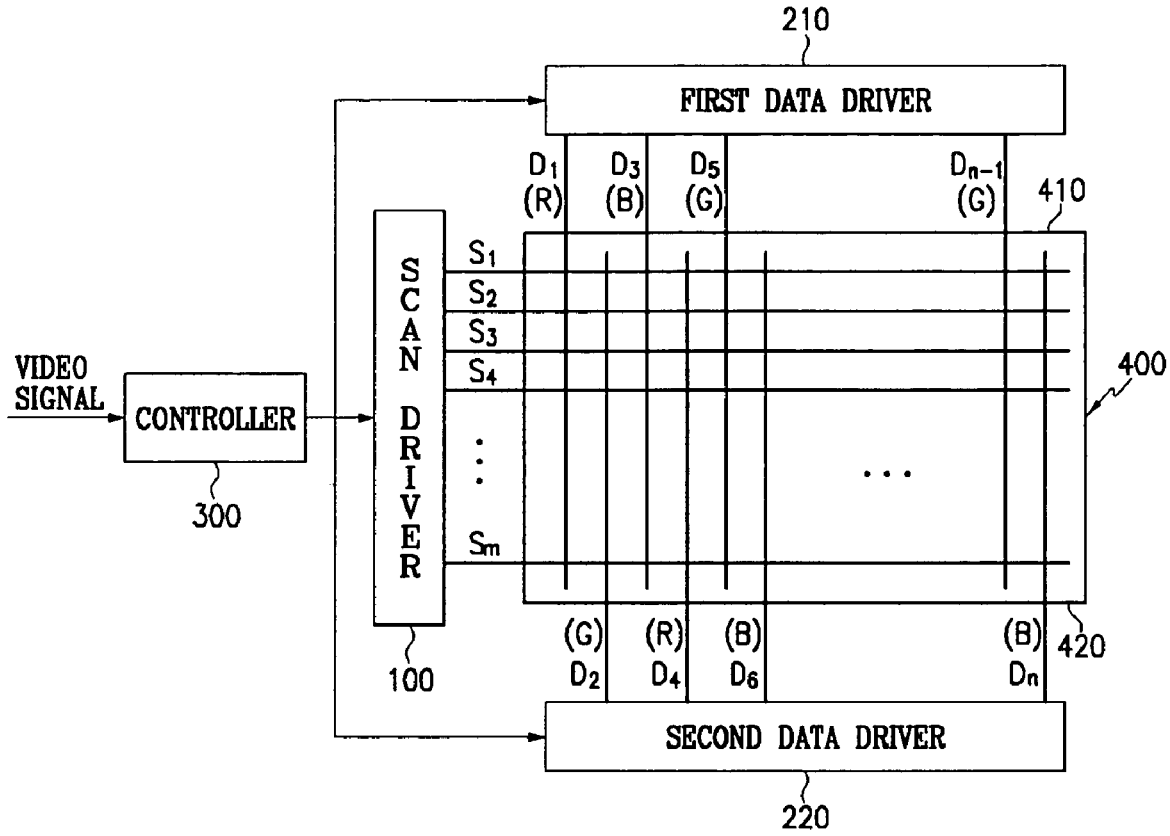
FIG. 3 is an illustration of an FED according to a first embodiment of the present invention.

FIG. 3 is an illustration of an FED according to a first embodiment of the present invention.

The FED according to the first embodiment of the present invention has electrodes in an n×m matrix, as shown in FIG. 3. More specifically, the FED includes data electrodes D1 to Dn arranged in columns, and scan electrodes S1 to Sm arranged in rows. Here, R, G, and B phosphors are alternately formed on the respective lines of the data electrodes.

Also, the FED according to the first embodiment of the present invention includes scan driver 100, first and second data drivers 210, 220, controller 300 and screen 400.

Controller 300 applies driving signals to scan driver 100 and first and second data drivers 210 and 220.

Scan driver 100 sequentially supplies the scan pulses from controller 300 to scan lines S1 to Sm.

First and second data drivers 210 and 220 supply data pulses to data lines D1 to Dn according to whether or not the data are provided. Here, odd data lines D2*i*−1 (where i is a natural number of 1 to n/2) receive data pulses from first data driver 210, and even data lines D2*i* receive data pulses from second data driver 220.

Namely, data line D1 corresponding to the R phosphor receives a data pulse from first data driver 210, data line D2 corresponding to the G phosphor receives a data pulse from second driver 220, and data line D3 corresponding to the B phosphor receives a data pulse from first data driver 210. Data line D4 corresponding to the second R phosphor receives a data pulse from second data driver 220.

In the first embodiment of the present invention, as described above, the data lines are divided into odd data lines and even data lines, so that the data pulse is applied to the odd data lines from upper side 410 of screen 400 through first data driver 210 and to the even data lines from lower side 420 of screen 400 through second data driver 220.

The odd one of the adjacent data lines receives a data pulse from upper side 410 of screen 400 and the even one receives a data pulse from lower side 420 of screen 400. So, the two adjacent data lines mutually compensate for a voltage drop to guarantee a uniform brightness of the entire image.

Although the data lines to be driven are classified into odd data lines and even data lines in the first embodiment of the present invention, they can also be divided in pixel units, which embodiment will be described below in detail with reference to FIG. 4.

Figure 4:
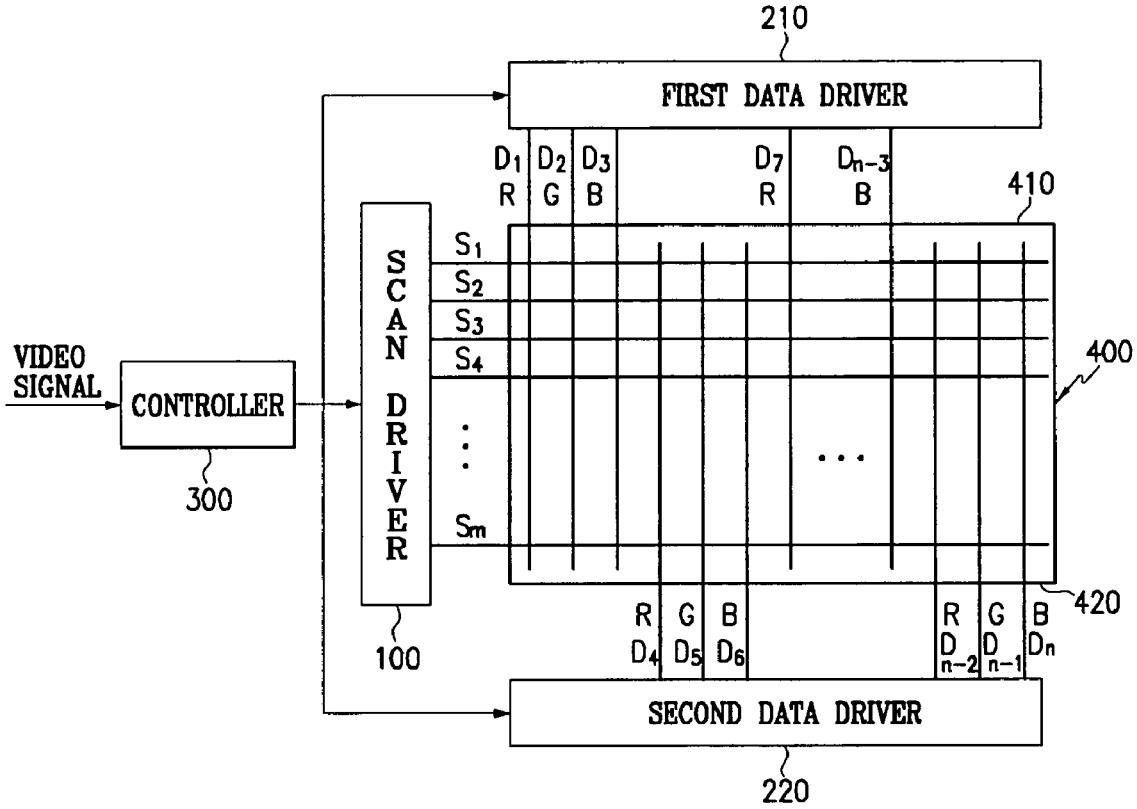
FIG. 4 is an illustration of an FED according to a second embodiment of the present invention.

FIG. 4 is an illustration of an FED according to a second embodiment of the present invention.

In the FED according to the second embodiment of the present invention, as shown in FIG. 4, the data lines constituting odd pixels receive a data pulse from first data driver 210 and the data lines constituting even pixels receive a data pulse from second data driver 220.

Namely, data lines D1 R, D2 G, and D3 B constituting a first pixel receive a data pulse from first data driver 210, and data lines D4 R, D5 G, and D6 B constituting a second pixel receive a data pulse from second data driver 220. Likewise, data lines D7 R, D8 G, and D9 B (D8 and D9 are not shown) constituting a third pixel receive a data pulse from first data driver 210.

In the second embodiment of the present invention, as described above, the data lines are divided into odd-pixel data lines and even-pixel data lines, so the data pulse is applied to the data lines connected to the odd pixels from upper side 410 of screen 400 through first data driver 210 and to the even data lines connected to the even pixels from lower side 420 of screen 400 through second data driver 220.

The odd one of the adjacent pixels receives a data pulse from upper side 410 of screen 400 and the even one receives a data pulse from lower side 420 of screen 400. So, the two adjacent pixels mutually compensate for a voltage drop to guarantee a uniform brightness of the entire screen.

While this invention has been described in connection with what is presently considered to be a practical exemplary embodiment, it is to be understood that the invention is not limited to the disclosed embodiments, but, on the contrary, is intended to cover various modifications and equivalent arrangements included within the spirit and scope of the appended claims.

According to the present invention, as described above, the data lines are divided into data lines in the upper side of the screen and data lines in the lower side of the screen and are then separately driven, thereby preventing a non-uniform brightness of the upper and lower sides of the screen caused by the resistance component of the data lines.

Furthermore, the data drivers are divided into a data driver for the upper side of the screen and a data driver for the lower side of the screen, so the size of the driving board can be reduced and the path of each driving line can be made uniform.

What is claimed is:

1. A field emission display comprising:

a first substrate;

a plurality of first electrodes formed on the first substrate in one direction;

a plurality of second electrodes insulated from and alternating with the first electrodes; an electron emission region for emitting electrons by a potential difference between the first and second electrodes; and a driver for outputting a signal corresponding to each of the first electrodes and the second electrodes, the first electrodes being divided into plural groups, each group including three of the first electrodes corresponding to a red phosphor, a green phosphor, and a blue phosphor of a pixel, respectively, the driver comprising a first data driver and a second data driver for outputting a data signal corresponding to the first electrodes, and a scan driver for outputting a selection signal to the second electrodes, the first data driver for outputting a data signal to a plurality of the first electrodes corresponding to one of two adjacent pixels, the second data driver for outputting a data signal to a plurality of the first electrodes corresponding to an other one of the two adjacent pixels.

2. The field emission display as claimed in claim 1, wherein the respective first electrodes sequentially correspond to one of the red phosphor, the green phosphor, and the blue phosphor, each group including one of the first electrodes.

3. The field emission display as claimed in claim 1, wherein the first electrodes include a gate electrode, and the second electrodes include a cathode electrode.

4. The field emission display as claimed in claim 1, wherein the first data driver and the second data driver are separately disposed on an upper side and a lower side of a screen for displaying an image.

5. A method for driving a field emission display, which includes a first substrate, a plurality of first electrodes formed on the first substrate in one direction, a plurality of second electrodes insulated from and alternating with the first electrodes, an electron emission region for emitting electrons by a potential difference between the first and second electrodes, and a driver for outputting a signal corresponding to each of the first and second electrodes, the first electrodes being divided into plural groups, each group including three of the first electrodes corresponding to a red phosphor, a green phosphor, and a blue phosphor of a pixel, the driver comprising a first data driver and a second data driver for outputting a data signal corresponding to the first electrodes, and a scan driver for outputting a selection signal to the second electrodes, the method comprising:

(a) sequentially applying the selection signal to the second electrodes through the scan driver; and (b) applying the data signal to a plurality of the first electrodes corresponding to one of two adjacent pixels through the first data driver, and applying the data signal to a plurality of the first electrodes corresponding to an other one of the two adjacent pixels through the second data driver.

6. The method as claimed in claim 5, wherein the data signal is applied through a first group of data lines and a second group of data lines, the first group of data lines applying the data signal from a first side of the field emission display and the second group of data lines applying the data signal from a second side of the field emission display opposite the first side of the field emission display.

7. The method as claimed in claim 5, wherein the data signal is applied through a first set of data lines connected to first pixel groupings at a first area of the field emission display and a second set of data lines connected to second pixel groupings at a second area of the field emission display, the first set of data lines applying the data signal from a first side of the field emission display adjacent the first area and the second set of data lines applying the data signal from a second side of the field emission display adjacent the second area.

* * * * *